United States Patent [19]

Laudet et al.

[11] Patent Number: 5,008,986

[45] Date of Patent: Apr. 23, 1991

[54] SLIDE FASTENER FOR CLOTHING AND SHOES

[75] Inventors: Jean-Luc Laudet, Poisy; Pierre Rullier, Annecy, both of France

[73] Assignee: Salomon S.A., Annecy Cedex, France

[21] Appl. No.: 460,971

[22] PCT Filed: Jun. 15, 1989

[86] PCT No.: PCT/FR89/00302

§ 371 Date: Feb. 9, 1990

§ 102(e) Date: Feb. 9, 1990

[87] PCT Pub. No.: WO89/12408

PCT Pub. Date: Dec. 28, 1989

[30] Foreign Application Priority Data

May 12, 1989 [FR] France ..... 89 06753
Jun. 17, 1989 [FR] France ..... 88 08405

[51] Int. Cl.[5] ..... A44B 19/32
[52] U.S. Cl. ..... 24/289; 24/414
[58] Field of Search ..... 24/389, 384, 414, 405, 24/427, 432; 36/101

[56] References Cited

U.S. PATENT DOCUMENTS

| | | | |
|---|---|---|---|
| 1,632,064 | 6/1927 | Gammeter | 24/414 |
| 2,095,453 | 10/1937 | Silberman et al. | 24/414 |
| 2,302,596 | 11/1942 | Bigio | 36/101 |
| 2,444,640 | 7/1948 | Epstein | 36/101 |
| 2,746,113 | 5/1956 | Williams | 24/389 |
| 3,082,501 | 3/1963 | Brown | 24/389 |
| 3,501,816 | 3/1970 | Heimberger | 24/389 |
| 3,668,745 | 6/1972 | Krupp | 24/389 |
| 3,874,037 | 4/1975 | Takamatsu | 24/389 |
| 4,580,321 | 4/1986 | Tanikawa et al. | 24/389 |
| 4,607,416 | 8/1986 | Tanikawa et al. . | |
| 4,724,586 | 2/1988 | Tsubokawa et al. | 24/389 |

FOREIGN PATENT DOCUMENTS

| | | | |
|---|---|---|---|
| 160859 | 11/1985 | European Pat. Off. . | |
| 164610 | 12/1985 | European Pat. Off. . | |
| 8203280 | 11/1982 | Fed. Rep. of Germany . | |
| 1256713 | 2/1961 | France . | |
| 2617379 | 1/1989 | France . | |
| 923254 | 4/1963 | United Kingdom . | |
| 926074 | 5/1963 | United Kingdom | 24/432 |
| 2053657 | 2/1981 | United Kingdom . | |

OTHER PUBLICATIONS

A Copy of the French Search Report.
A Copy of the International Search Report.
German language abstract of German Patent No. 8,203,280.

*Primary Examiner*—Victor N. Sakran
*Attorney, Agent, or Firm*—Sandler, Greenblum & Bernstein

[57] ABSTRACT

Slide fastener for footwear or protective garments constituted of two support tapes (13) off chains of teeth (11) and a slide-tab (16). The chains of teeth (11) of the slide fastener are connected to their respective support tape (13) and mounted, brought together, such that they are located raised on the single side (13'') of said tapes adapted to be turned towards the inside of said footwear or garment.

Figure of the abstract: figure 1.

14 Claims, 3 Drawing Sheets

SLIDE FASTENER FOR CLOTHING AND SHOES

The present invention relates to slide fasteners fitting footwear or protective garments, particularly sporting shoes and cross-country ski shoes or boots.

The usage of slide fasteners, because of their practical usage characteristics, is now widespread; it can particularly be recalled that such fasteners are easy to manipulate for their opening, and that the mounting of the fastener avoids the covering of the quarters of the shoe or boot which are folded on the foot of the wearer as is the case in fasteners of the "hook-loop" type or with buttoning: by way of example, the shoe or boot model "CS 420" presented in the catalog "TRAK 86-87" can be cited as well as the shoe or boot disclosed in the patent for Italian industrial model No. 193 252 where the fastening is of the "hook-loop" type. As can be seen in these shoes or boots, the quarter of the upper which ensures the fastening on the foot widely covers the opposite quarter on which it hooks. In such embodiments, not only the necessity of covering the quarters leads to an additional furnishing of implemented materials, and thus an elevated cost, but this covering of the quarters affects the suppleness of the upper because of their superimposition which substantially doubles the thickness of the wall of the upper in this fastening zone. For these different reasons, the slide fasteners have very often been preferred to other types of fasteners because they make it possible to abut in a single plane the parts to be assembled, and to eliminate as a result, any excessive thickness of the wall; by way of example, the shoes or boots described in the British Pats. Nos. 531 776 and 380 909, the French certificate of usage No. 2 549 701, and U.S. Pats. Nos. 2,444,640 and 2,970,390 can be cited which exactly use slide fasteners. The shoes or boots illustrated in these documents have at least one slide fastener, joined or not joined to a lacing device, positioned on the upper front part of the upper of said shoes or boots. These slide fasteners generally constituted of teeth, spirals, etc. successively engaging with one another to ensure the joining of the walls of the shoe or boot, are universally oriented along the longitudinal axis of the shoe or boot or parallel thereto. In the particular embodiment of U.S. Pat. No. 2,444,640, the fastener surrounds the upper front part of the upper and retains the latter on the lower part of the upper.

These shoes or boots offer an undeniable convenience of usage for operations of insertion and removal. However, they have the significant disadvantage of being relatively unsealed in the zone for hooking their teeth, spirals, etc.; in fact the hooking of the latter between them is carried out by nesting; it is necessary to make use of a functional play which, in an inherent manner, constitutes a permeable zone. In addition, the slide fasteners being relatively deformable in the longitudinal direction of their mounting, they curve during flexions of the foot so that any obstacle is removed from the access to their hooking zone at the location of their raised curves and increase the functional play between the teeth or spirals, thus favoring permeability to water, the incrustation of snow, ice, even dirt.

The present invention aims to eliminate the disadvantages due to the flexion of the upper during the bending of the foot which were evoked with these slide fasteners by eliminating, on the one hand, risks of local deteriorations of the fastener at the level of the raised parts, and on the other hand, by guaranteeing an optimal seal, to dirt as well as snow and water.

To do this, the present invention relates to a slide fastener for footwear or protective garment whose fastener constituted of two support tapes of a chain of teeth and a slide is mounted on a part of said article or garment whose two edges are to be brought together and is characterized by the fact that the chains of teeth are connected to their respective support tapes such that they are located raised on the single side of said tapes intended to be turned towards the inside of said footwear or garment.

According to another characteristic of the invention and to ensure the imperviousness of the slide fasteners of chain of teeth supports are coated with a sealing layer which can cover at least the means for mounting the chain of teeth on the support, to extend, if necessary, at the level of the implantation of the chain of teeth with respect to the support of said chain of teeth.

According to an additional characteristic, this coating of a sealing layer is applied preferably to the side of the support adapted to be turned towards the outside of the shoe or boot.

The characteristics of the invention are exposed in the description which follows and for the understanding of which one will be referred to the drawings in which.

Figure 1:
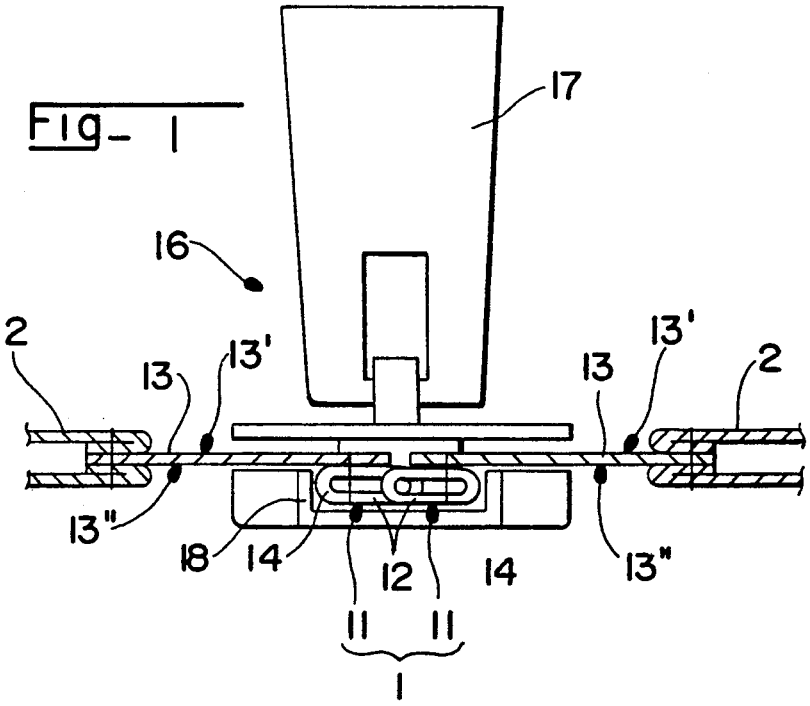
FIGS. 1 and 2 show in detail, a part of a slide fastener according to the invention, FIG. 1 being a sectional view along II—II of FIG. 2 which is illustrating, seen in planar view, the end of the fastener with the slide.
Figure 2:
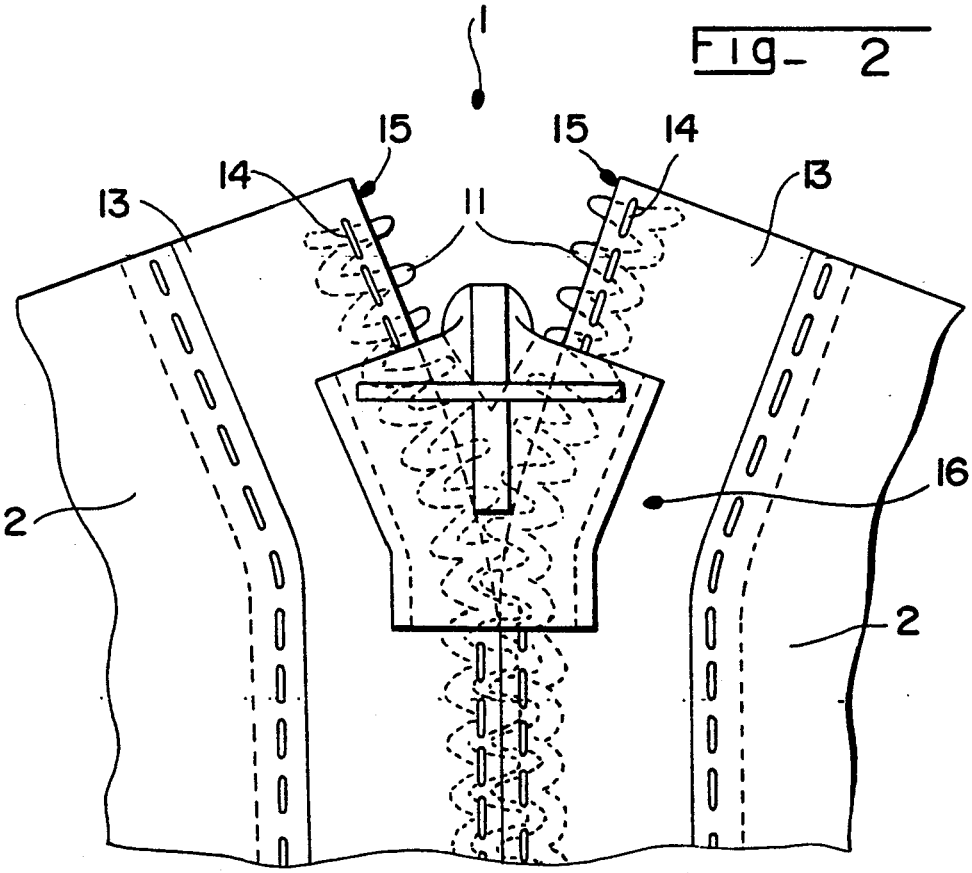

According to the invention, FIGS. 1 and 2, the slide fastener 1 is of the type whose chains of teeth 11 extend over a single side of their respective support tape 13 and is characterized in that it comprises a slide 16 whose pull tab 17 is positioned on the side opposite the linkage tunnel 18 of said chains of teeth 11.

According to another characteristic of the invention, the teeth 12 (or spirals as is the case in this embodiment) are affixed and applied to a single side of each support tape 13 by means of stitches or staples 14, at a certain distance from the border 15 of said tape; this distance is determined with respect to the depth of nesting of the teeth or spirals 12 so that the borders 15 of the tapes 13 of slide fastener 1 are joined and only leave a line of separation 15' visible when the chains of teeth 11 are nested. According to an alternative embodiment, not shown, the chains of teeth 11 are affixed at a distance substantially less than that corresponding to the depth of nesting of the teeth or spirals 12. Thus, when the chains of teeth 11 are interlocked with one another by means of the slide 16, the borders 15 of the tapes 13 are applied with a certain pressure against one another or overlapping which, in every case, improves the imperviousness of slide fastener 1.

Figure 3:
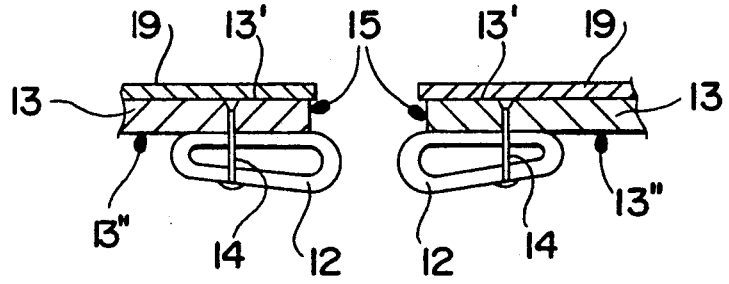
FIG. 3 shows, in enlarged sectional view, a fastener according to the invention provided with a sealing film in the separated position.
Figure 4:
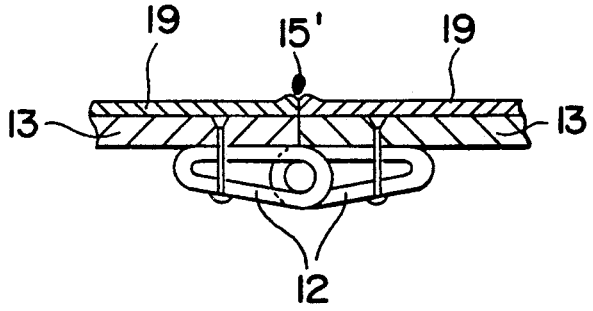
FIG. 4 shows the fastener according to FIG. 3 in the closed position.

It is obvious that such a slide fastener 1, object of the invention, only has relevance when it is mounted, on the support 2 to be closed, in the direction where the chains of teeth 11 are directed on the side least exposed to dirt, snow, mud, water, etc., i.e., on side 13'' of the tape turned towards the inside of the footwear, even protective garment, the opposite side 13' of this tape then ensuring a protection towards the outside of the chains of teeth. Moreover, as illustrated in FIGS. 3 and 4, the mechanical sealing of slide fastener 1 will be favorably reinforced by the implementation of known processes for waterproofing and particularly by processes of coating with a sealed layer 19, for example, of polymerizable liquid materials or not, translucent, opaque, or of varied colors, on the exterior side 13' of each tape 13 after placement of the teeth 12 of chain of teeth 11. This sealing coat 19 will complete the mechanical sealing of the slide fastener because it is applied without any obstacle on the planar surface 13' of support tape 13 of the chain of teeth intended to be turned towards the outside of the shoe or boot, even a protective element, for example. Because of this application, after mounting of the chain of teeth, the sealed coating 19 made on this exposed surface 13' of support tapes 13 covers and seals the stitches or staples 14 without there being the slightest gap capable of a certain permeability to water, dirt, etc., and thus guarantees an absolute sealing towards the outside of the slide fastener. When slide fastener 1 is closed, one is then in the presence, exterior side, of a separation line 15' marking the joining of both the borders 15 against one another and the two coating layers 19 coming from each of the support tapes 13 whose said coated borders 15 thus fill the role of linear seal. In the case shown in FIGS. 3 and 4, the sealed layer 19 projects slightly over the edge of each tape 13, such that the linear seal is obtained particularly by compression of the two layers of coating 19 when they are placed end to end under the action of bringing together the chains of teeth due to the displacement of the closure of slide 16.

Of course, the sealed layer 19 can likewise be applied so as to not project with respect to support tape 13.

Figure 5:
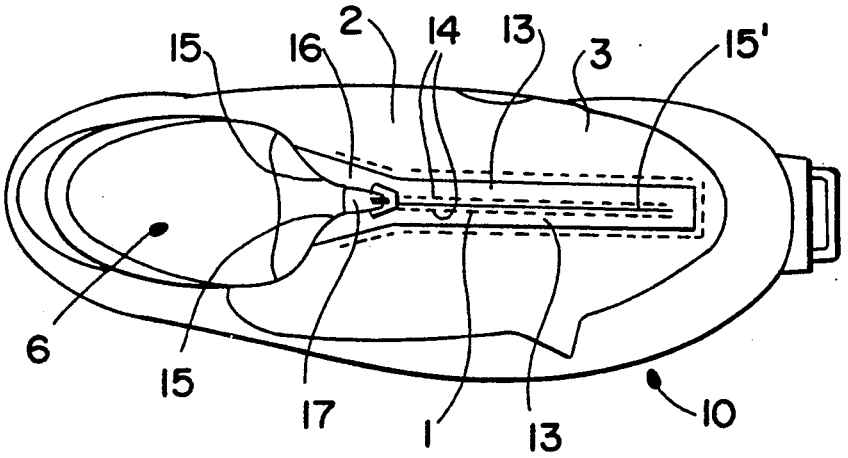
FIG. 5 shows a slide fastener in conformance to the invention mounted on the upper of a cross-country ski shoe or boot.
Figure 6:
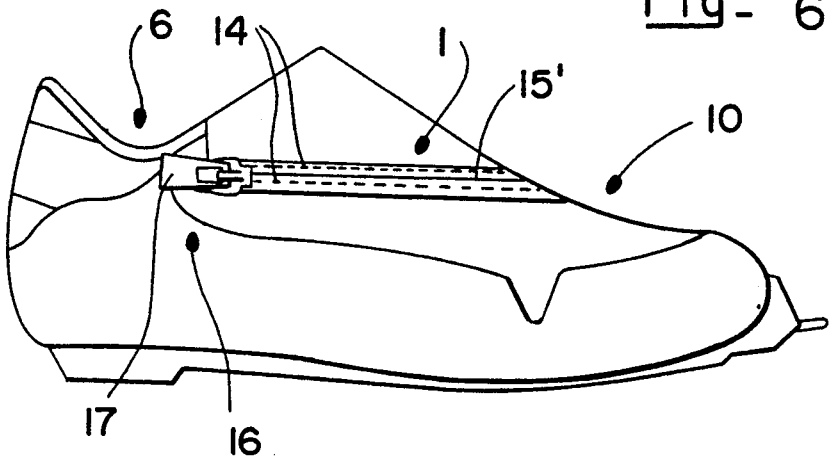
FIGS. 6 and 7 illustrate another method of mounting the slide fastener still according to the invention.
Figure 7:
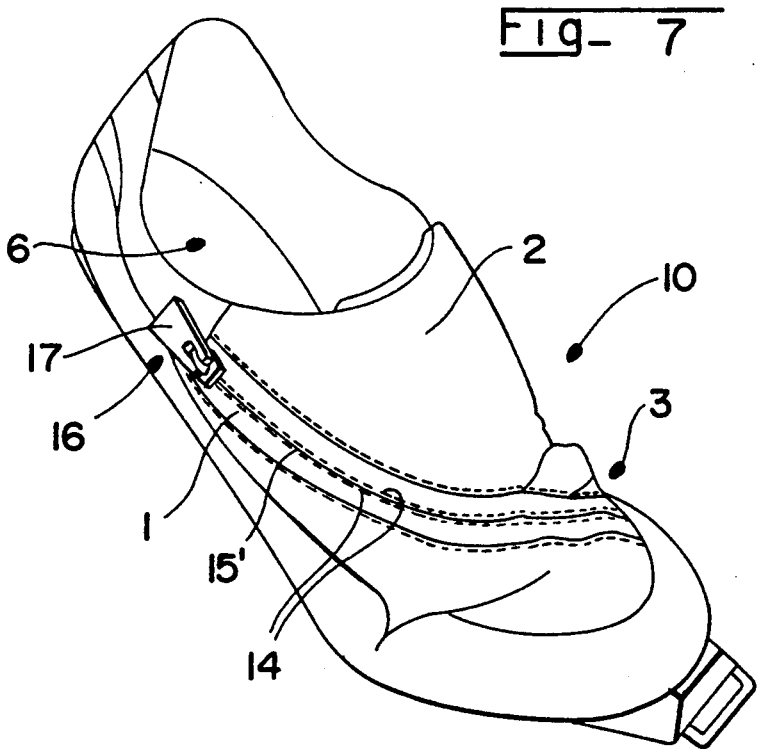

In FIGS. 5–7 which follow, there are illustrated cross-country ski shoes or boots comprising a slide fastener 1 conforming to the invention.

In FIG. 5, the slide fastener 1 is positioned, in a conventional manner, on the front part of upper 2 substantially in the longitudinal axis of the shoe or boot 10 and extends approximately as far as zone 3 corresponding to that of the metatarso-phalangeal joint of the foot (not illustrated). As this was revealed with reference to FIGS. 1 and 2, the slide fastener 1 has support tapes 13 which are turned only towards the outside of the shoe or boot, while its chains of teeth are directed on the interior side of upper 2, the separation line 15' of borders 15 of said tapes appear also on the exterior side of the shoe or boot. It is obvious that the stitches or staples 14 are only visible if tapes 13 have not been coated with an opaque or colored sealed coating as evoked previously in the description of FIG. 3. Of course, the slide fastener 1 according to the invention can also be positioned in other manners on shoe or boot uppers, particularly to use the advantages resulting from the relative longitudinal flexibility of its mounting.

Thus, for example, as can be seen in FIGS. 6 and 7 illustrating the example of an application to another cross-country shoe or boot 10, slide fastener 1 conforming to the invention is positioned on upper 2 by extending along a direction inclined with respect to the median longitudinal axis of the shoe or boot. In this manner, for the most part, problems connected to repeated longitudinal deformations of the slide fastener 1 due to the bending of the foot occurring grosso modo about instantaneous rotation axes perpendicular to the longitudinal axis of the shoe or boot, are eliminated. In the application shown, slide fastener 1 runs along upper 2 of the zone 3 corresponding substantially to that of the metatarso-phalangeal joint of the foot towards the rear and the external side of the instep in the direction of zone 6 of the external malleolus of the foot.

It can be seen that this particular arrangement of the slide fastener 1, permits a localization of flexion zones limited to the single metatarso-phalangeal zone 3, and as a result, considerably softens the raised curves of the slide fastener 1 favorable to the formation of sites where snow and ice could lodge. Thus, the shoe or boot is placed in conditions similar to those of a shoe or boot whose upper would not support a slide fastener. There results from such an arrangement that the hooking zone of the chains of teeth 11 is never uncovered and thus remains protected from dirt and water.

It is also fitting to add that the part of slide fastener 1 which runs along the side of the instep not being subjected to significant flexion or deformation forces in this foot zone, the slide fastener is all the more efficient to ensure a good hold of the foot in the shoe or boot, without comfort being affected.

Without going beyond the scope of the invention, upper 2 of such a shoe or boot can, at least in the upper covering zone for the foot, be provided in an extensible and/or elastic material which is possibly impervious. Likewise, at least one of the parts of upper 2 adjacent to support tapes 13 of slide fastener 1, or even at least one of support tapes 13, can be obtained in an extensible material; in this manner, upper 2 will be tightly applied to the foot whatever the volume of the latter.

I claim:

1. A slide fastener for uniting edges of two elements in a sealing relationship, each said element including an interior and exterior side, said slide fastener comprising:

(a) two support tapes, each support tape being on a respective element, each support tape having an interior and exterior side and a respective border;

(b) two chains of teeth, each chain of teeth being connected only to the interior side of a respective support tape; and (c) a slide including a linkage tunnel and a tab, said linkage tunnel being positioned on the interior side of said support tapes, said pull tab extending from said linkage tunnel to the exterior side of said support tapes.

2. The slide fastener according to claim 1, comprising means for sealing being located on at least one of the exterior and interior sides of said support tapes, said sealing means covering the borders of each said support tape.

3. The slide fastener according to claim 2, wherein said means for sealing is located on the exterior side of said support tapes.

4. The slide fastener according to claim 3, wherein said means for sealing is a respective layer of material which covers the borders of each said support tape and extends over a respective chain of teeth, each layer of material including an edge.

5. The slide fastener according to claim 4, wherein each chain of teeth is fixed to a respective support tape at a predetermined distance from a respective border, said distance determining a line of separation and forms a seal between the edges of said means for sealing when the slide fastener unites said two elements.

6. The slide fastener according to claim 5, wherein said predetermined distance allows compression of said means for sealing when the slide fastener unites said two elements.

7. The slide fastener according to claim 5, wherein said predetermined distance allows the respective edges of said sealing means to overlap wherein the slide fastener unites said two elements.

8. The slide fastener according to claim 1, wherein at least one of said support tapes is formed from an elastic material.

9. The slide fastener according to claim 1, wherein at least one of said elements is formed from an electric material.

10. The slide fastener according to claim 9, wherein said elastic material is impervious.

11. The slide fastener according to claim 1, wherein at least one of said elements is formed from an impervious material.

12. The slide fastener according to claim 1, wherein said elements are located on footwear having a longitudinal axis, said slide fastener extending substantially along said longitudinal axis.

13. The slide fastener according to claim 1, wherein said elements are located on footwear having a longitudinal axis, said slide fastener extending along a direction which is inclined to said longitudinal axis.

14. The slide fastener according to claim 13, wherein said slide fastener extends from the area of the metatarso-phalangeal joint of the foot of the wearer towards the rear and the external side of the instep to the area of the external malleolus of the foot of the wearer.

* * * * *

US005008986C1

(12) EX PARTE REEXAMINATION CERTIFICATE (5923rd)

United States Patent

Laudet et al.

(10) Number: US 5,008,986 C1

(45) Certificate Issued: *Oct. 9, 2007

(54) SLIDE FASTENER FOR CLOTHING AND SHOES

(75) Inventors: Jean-Luc Laudet, Poisy (FR); Pierre Rullier, Annecy (FR)

(73) Assignee: Salomon S.A., Annecy Cedex (FR)

Reexamination Request:
No. 90/007,644, Jul. 25, 2005

Reexamination Certificate for:

| | |
|---|---|
| Patent No.: | **5,008,986** |
| Issued: | **Apr. 23, 1991** |
| Appl. No.: | **07/460,971** |
| Filed: | **Feb. 9, 1990** |

( * ) Notice: This patent is subject to a terminal disclaimer.

(22) PCT Filed: Jun. 15, 1989

(86) PCT No.: PCT/FR89/00302

§ 371 (c)(1),
(2), (4) Date: Feb. 9, 1990

(87) PCT Pub. No.: WO89/12408

PCT Pub. Date: Dec. 28, 1989

(30) Foreign Application Priority Data

Jun. 17, 1988 (FR) ..... 88 08405
May 12, 1989 (FR) ..... 89 06753

(51) Int. Cl.

| | |
|---|---|
| *A43C 11/12* | (2006.01) |
| *A44B 19/32* | (2006.01) |
| *A44B 19/34* | (2006.01) |

(52) U.S. Cl. ..... 24/389; 24/414

(58) Field of Classification Search ..... None
See application file for complete search history.

(56) References Cited

U.S. PATENT DOCUMENTS

| | | | | |
|---|---|---|---|---|
| 1,632,064 A | | 6/1927 | Gammeter | |
| 2,095,453 A | * | 10/1937 | Silberman et al. | 24/414 |
| 2,190,579 A | * | 2/1940 | Wash | 36/50.1 |
| 2,302,596 A | | 11/1942 | Bigio | |
| 2,444,640 A | * | 7/1948 | Epstein | 36/101 |
| 2,746,113 A | | 5/1956 | Williams | |
| 2,967,359 A | * | 1/1961 | Barron | 36/117.6 |
| 2,970,390 A | | 2/1961 | Brough et al. | |
| 3,082,501 A | | 3/1963 | Brown | |
| 3,491,465 A | * | 1/1970 | Martin | 36/99 |

(Continued)

FOREIGN PATENT DOCUMENTS

| | | | |
|---|---|---|---|
| DE | 8203280 U1 | | 11/1982 |
| EP | 0 099 484 A1 | | 2/1984 |
| EP | 0 160 859 A2 | | 11/1985 |
| EP | 0 164 610 A2 | | 12/1985 |
| FR | 1 256 713 | | 2/1961 |
| FR | 2 617 379 A1 | | 1/1989 |
| GB | 923254 A | * | 4/1963 |
| GB | 926074 | | 5/1963 |
| GB | 2 053 657 A | | 2/1981 |
| GB | 2 124 297 A | | 2/1984 |

OTHER PUBLICATIONS

YKK Sliders Catalogue 1983, images of sliders on three pages, each page titled "Standard Sliders for Coil Zippers."

*Primary Examiner*—Peter C. English

(57) ABSTRACT

Slide fastener for footwear or protective garments constituted of two support tapes (13) off chains of teeth (11) and a slide-tab (16). The chains of teeth (11) of the slide fastener are connected to their respective support tape (13) and mounted, brought together, such that they are located raised on the single side (13") of said tapes adapted to be turned towards the inside of said footwear or garment.

Figure of the abstract: figure 1.

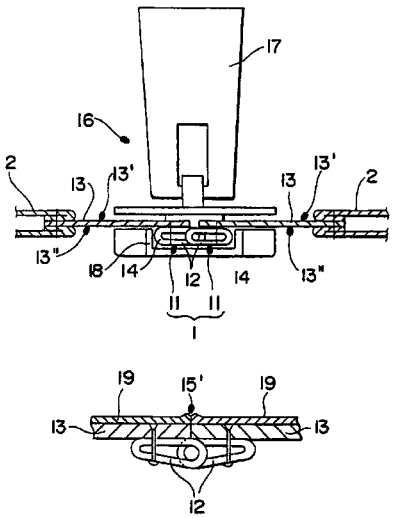

U.S. PATENT DOCUMENTS

| | | | | | |
|---|---|---|---|---|---|
| 3,501,816 | A | | 3/1970 | Heimberger | |
| 3,668,745 | A | | 6/1972 | Krupp | |
| 3,874,037 | A | | 4/1975 | Takamatsu | |
| 4,034,444 | A | | 7/1977 | Moertel | |
| 4,099,302 | A | | 7/1978 | Frohlich et al. | |
| 4,392,311 | A | | 7/1983 | Rudolf et al. | |
| 4,562,622 | A | | 1/1986 | Takabatake | |
| 4,562,654 | A | * | 1/1986 | Hue | 36/117.2 |
| 4,580,321 | A | | 4/1986 | Tanikawa et al. | |
| 4,607,416 | A | | 8/1986 | Tanikawa et al. | |
| 4,706,392 | A | * | 11/1987 | Yang | 36/101 |
| 4,724,586 | A | | 2/1988 | Tsubokawa et al. | |
| 5,020,247 | A | * | 6/1991 | Barret et al. | 36/50.1 |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 41–46:

According to the invention, FIGS. 1 and 2, the slide fastener 1 is of the type whose chains of teeth 11 extend over a single side of their respective support tape 13 and is characterized in that it comprises a slide 16 whose pull tab 17 is positioned on the side opposite the linkage tunnel 18 [of] *for* said chains of teeth 11.

Column 3, line 61 to column 4, line 8:

Thus, for example, as can be seen in FIGS. 6 and 7 illustrating the example of an application to another cross-country shoe or boot 10, slide fastener 1 conforming to the invention is positioned on upper 2 by extending along a direction inclined with respect to the median longitudinal axis of the shoe or boot. In this manner, for the most part, problems connected to repeated longitudinal deformations of the slide fastener 1 due to the bending of the foot occurring grosso modo about instantaneous rotation axes perpendicular to the longitudinal axis of the shoe or boot, are eliminated. In the application shown, slide fastener 1 runs along upper 2 of the zone 3 corresponding substantially to that of the metatarso-phalangeal joint of the foot towards the rear and the external side of the instep in the direction of zone 6 of the external malleolus of the foot. *As can be observed from FIGS. 6 and 7, the two chains of teeth of the slide fastener 1 extend in a direction between a front end and a rear end thereof along a front part of the upper 2 and, along their length, the chains extend in a direction inclined relative to the longitudinal axis of the shoe/boot over a top-most extent of a transverse cross section of the upper.*

AS A RESULT OF REEXAMINATION, IT HAS BEEN DETERMINED THAT:

Claim 2 is cancelled.

Claims 1, 3, 9, 12 and 13 are determined to be patentable as amended.

Claims 4–8, 10, 11 and 14, dependent on an amended claim, are determined to be patentable.

New claims 15–29 are added and determined to be patentable.

1. A slide fastener for uniting edges of two elements in a sealing relationship, each said element including an interior and exterior side, said slide fastener comprising:

(a) two support tapes, each support tape being on a respective element, each support tape having an interior and exterior side and a respective border;

(b) two chains of teeth, each chain of teeth being connected only to the interior side of a respective support tape; [and]

(c) a slide including a linkage tunnel and a tab, said linkage tunnel being positioned on the interior side of said support tapes, said pull tab extending from said linkage tunnel [to] *on* the exterior side of said support tapes*; and*

(*d*) *means for sealing located on at least one of the exterior and interior sides of said support tapes, said sealing means covering the borders of each said support tape.*

3. The slide fastener according to claim [2] *1*, wherein said means for sealing is located on the exterior side of said support tapes.

9. The slide fastener according to claim 1, wherein at least one of said elements is formed from an [electric] *elastic* material.

12. The slide fastener according to claim 1, wherein said *two* elements [are located on] *comprise two portions of an upper of an article of* footwear*, said article of footwear* having a longitudinal axis, said slide fastener extending substantially along said longitudinal axis.

13. The slide fastener according to claim 1, wherein said *two* elements [are located on] *comprise two portions of an upper of an article of* footwear*, said article of footwear* having a longitudinal axis, said slide fastener extending along a direction which is inclined to said longitudinal axis.

*15. The slide fastener according to claim 12, wherein said slide fastener extends through at least one flexion zone on said footwear.*

*16. The slide fastener according to claim 15, wherein said at least one flexion zone is a metatarso-phalangeal zone.*

*17. The slide fastener according to claim 13, wherein said slide fastener extends through at least one flexion zone on said footwear.*

*18. The slide fastener according to claim 17, wherein said at least one flexion zone is a metatarso-phalangeal zone.*

*19. An article of footwear comprising:*

*an upper comprising at least two elements, each of said two elements having an interior side, facing an inside of the article of footwear, and an exterior side;*

*a slide fastener for uniting edges of said two elements in a waterproof sealing relationship, said slide fastener comprising:*

*two support tapes, each support tape being on a respective element, each support tape having an interior side, an exterior side, and a respective border;*

*two chains of teeth, each chain of teeth being attached upon only the interior side of a respective one of said two support tapes;*

*a slide comprising:*

*a linkage tunnel; and*

*a pull tab;*

*said linkage tunnel being positioned on the interior side of said support tapes, said pull tab extending from said linkage tunnel on the exterior side of said support tapes.*

*20. An article of footwear according to claim 19, wherein: the slide fastener is located on a front part of the upper.*

*21. An article of footwear according to claim 20, wherein: the article of footwear is a cross-country ski shoe.*

*22. An article of footwear according to claim 21, wherein: the article of footwear has a longitudinal axis, said two chains of teeth extending substantially along said longitudinal axis.*

*23. An article of footwear according to claim 20, wherein:*

*the upper has an upper edge extending beneath a zone of a malleolus of a wearer's foot, when the article of footwear is worn.*

*24. An article of footwear according to claim 19, wherein:*

*said two chains of teeth extend through at least one flexion zone of the upper.*

*25. An article of footwear according to claim 24, wherein:*

*said flexion zone is a metatarso-phalangeal zone of the upper.*

*26. An article of footwear according to claim 25, wherein:*

*said two chains of teeth have an entire length extending in a direction between a front end and a rear end, said two chains of teeth extending in said direction along a front part of said upper over a top-most extent of a transverse cross section of said upper.*

*27. An article of footwear comprising:*

*an upper comprising at least two elements, each of said two elements having an interior side, facing an inside of the article of footwear, and an exterior side;*

*a slide fastener, located on a front part of the upper, for uniting edges of said two elements in a sealing relationship, said slide fastener comprising:*

*two support tapes, each support tape being on a respective element, each support tape having an interior side, an exterior side, and a respective border;*

*two chains of teeth, each chain of teeth being attached upon only the interior side of a respective one of said two support tapes;*

*the article of footwear having a longitudinal axis, said two chains of teeth extending along a direction inclined relative to said longitudinal axis;*

*a slide comprising:*

*a linkage tunnel; and*

*a pull tab;*

*said linkage tunnel being positioned on the interior side of said support tapes, said pull tab extending from said linkage tunnel on the exterior side of said support tapes;*

*the article of footwear being a cross-country ski shoe.*

*28. An article of footwear comprising:*

*an upper comprising at least two elements, each of said two elements having an interior side, facing an inside of the article of footwear, and an exterior side;*

*a slide fastener, located on a front part of the upper, for uniting edges of said two elements in a sealing relationship, said slide fastener comprising:*

*two support tapes, each support tape being on a respective element, each support tape having an interior side, an exterior side, and a respective border;*

*two chains of teeth, each chain of teeth being attached upon only the interior side of a respective one of said two support tapes;*

*means for sealing said upper against infiltration of foreign material between said two elements, said means for sealing being located on the exterior side of said support tapes;*

*a slide comprising:*

*a linkage tunnel; and*

*a pull tab;*

*said linkage tunnel being positioned on the interior side of said support tapes, said pull tab extending from said linkage tunnel on the exterior side of said support tapes.*

*29. An article of footwear according to claim 28, wherein:*

*said two chains of teeth are attached with stitches upon the interior side of a respective support tape;*

*said means for sealing covers and seals the stitches against infiltration of foreign material, said stitches not being visible from the exterior side of the two elements of said upper.*

* * * * *